United States Patent [19]

Mustee

[11] Patent Number: 4,508,304

[45] Date of Patent: Apr. 2, 1985

[54] LAUNDRY TUB MOUNTING APPARATUS

[75] Inventor: Robert J. Mustee, Middleburg Heights, Ohio

[73] Assignee: E. L. Mustee & Sons, Inc., Cleveland, Ohio

[21] Appl. No.: 470,062

[22] Filed: Feb. 28, 1983

[51] Int. Cl.[3] ..... A47K 1/04

[52] U.S. Cl. ..... 248/311.2; 4/647

[58] Field of Search ..... 248/311.2, 345.1; 4/640, 643, 647–649

[56] References Cited

U.S. PATENT DOCUMENTS

| | | | |
|---|---|---|---|
| 2,233,332 | 2/1941 | Wagner | 248/311.2 |
| 2,628,054 | 2/1953 | Fazakerley | 248/311.2 |
| 3,364,503 | 1/1968 | Mustee | 4/170 |
| 3,427,664 | 2/1969 | Mustee | 4/183 |
| 3,762,626 | 10/1973 | Dorsey | 248/345.1 |
| 3,957,781 | 8/1976 | Klimboff | 4/170 |
| 4,044,980 | 8/1977 | Cummins | 248/456 |

OTHER PUBLICATIONS

Assembly Instructions for Model 27W Laundry Tub.

*Primary Examiner*—Reinaldo P. Machado
*Assistant Examiner*—Alvin Chin-Shue
*Attorney, Agent, or Firm*—Watts, Hoffmann, Fisher & Heinke Co.

[57] ABSTRACT

Apparatus for mounting a wall hung laundry tub 10 or the like comprising a conventional mounting plate 16 secured to the wall 12 which is engageable with a ledge 14 formed near the top of the tub and a pair of side fillers 20 extending between the rear of the tub 18 and the wall which cover the plumbing access region behind the tub and maintain the spatial distance between the bottom of the tub and the wall to prevent the tub from cantilevering toward the wall. The side filler comprises a cover portion 22 and a load bearing portion 24 interconnected by structure defining a fold line 50 about which the portions are bent into a 90° or L-shaped configuration. The side filler is constructed from a plastic material such as polypropylene and the interconnection is formed by a relatively narrow bridging section 50*a* defining a living hinge that enables the side filler to be folded along the fold line without fracturing or damaging the interconnecting structure. The load bearing portion includes a plurality of reinforcing ribs 34, triangular in cross-section, defining longitudinal axes that intersect the tub support wall at an angle of substantially 90°.

13 Claims, 5 Drawing Figures

LAUNDRY TUB MOUNTING APPARATUS

DESCRIPTION

1. Technical Field

The present invention relates generally to laundry tub installations and in particular to a mounting apparatus for mounting wall hung type laundry tubs, or the like.

2. Background Art

Methods and apparatus for mounting wall hung laundry tubs are known in the art. Prior suggested laundry tub mounting hardware generally includes a mounting plate suitably attached to a support wall and side plates that extend between the rear of the tub and the wall. These side plates in most installations serve two purposes. Firstly, they cover the access space between the rear of the laundry tub and the wall to hide the plumbing from view, thereby improving the cosmetic appearance of the installation. Secondly, and often more importantly, the side plates provide support for the bottom edge of the tub to rigidize the installation and prevent the tub from cantilevering towards the wall when it is filled with water. Examples of prior suggested laundry tub installations are illustrated in U.S. Pat. No. 3,364,503 which is owned by the present assignee and U.S. Pat. No. 3,975,781. Although at least some of the prior tub mounting apparatus has enjoyed commercial success, less expensive tub mounting hardware and reduced tub installation time is still desirable.

DISCLOSURE OF THE INVENTION

The present invention provides a new and improved apparatus for mounting wall hung laundry tubs or the like, which is relatively inexpensive to manufacture and reduces the overall tub installation time.

In the preferred embodiment, the apparatus includes a mounting plate that is suitably attached to the wall or other vertical support surface and at least one, but preferably, two side plates or "side fillers" that extend between the tub support surface and the rear of the laundry tub. In accordance with the invention, each side filler is a unitary structure and includes a cover portion and a load bearing portion oriented substantially 90° with respect to each other when the side filler is installed. The cover portion extends between the back of the tub and the tub support wall, and covers the plumbing access region thereby enhancing the appearance of the installation. When installed, the outside surface of the cover portion is substantially flush with the side of the tub.

The new mounting plate is constructed in such a way that it can be economically made of plastic and molded, while still being strong enough to resist cantilever loading of up to 320 pounds and higher. In the preferred embodiment, the load bearing portion of the side filler extends between the bottom of the tub and the tub support wall and includes a plurality of parallel, reinforcing ribs that serve to rigidize the load bearing portion. One side of the load bearing portion is at least partially secured to the bottom of the tub, and the opposite side abuts the tub support wall.

The reinforcing ribs are preferably triangular in cross-section and extend between a pair of upwardly projecting, fore and aft abutment walls, forming part of the load bearing portions of the side filler. The fore and aft abutment walls are co-planar with the tub mounting wall, and confrontingly engage the back of the tub and the wall, respectively. The loading forces exerted on the ribs by the tub are directed along the longitudinal axis of the ribs.

When the side filler of the present invention is mounted to the tub, the planes of the cover and load bearing portions define an angle of substantially 90°. According to a feature of the invention, the side filler is preferably molded in a flat configuration, from a plastic material such as polypropylene. Prior to installation, the side filler is folded along a line of weakness defined between the two portions to shape the side filler into its installed configuration. In the preferred embodiment, the connection is formed by a living hinge so that the side filler can be folded without damage or fracture along the fold line.

This constructional feature facilitates the manufacture of the side filler and substantially reduces the size of the shipping package for the fillers without sacrificing side filler strength.

According to another feature of the invention, interfitting structures are formed on either side of the hinge line so that when the side filler is folded into its installed configuration, surfaces on the cover portion move into a side-by-side relationship with cooperating surfaces on the load bearing portion. The confronting co-engagement between these surfaces inhibits twisting of the side filler, adding to its rigidity.

According to the preferred embodiment, the cover portion includes an integrally formed, vertically extending tab that is engageable with a slot formed in the upper portion of the tub. The load bearing portion is preferably connected to the bottom of the tub by a transversely extending plate-like extension that includes an aperture for receiving a downwardly depending pin or boss formed on the lower portion of the tub. Apertures are formed in this extension plate through which threaded fasteners extend to threadedly engage the bottom of the tub.

With the preferred configuration, the installation time of the side fillers is substantially reduced. To install the filler it is unpackaged and folded 90° along the hinge line. The vertical tab at the top of the cover portion is inserted into its mating slot in the tub and the tub engaging extension plate is moved into engagement with the downwardly depending tub boss. One or more threaded fasteners are then driven into the bottom of the tub, through the apertures in the tub engaging extension plate to complete the installation. Once installed, the fasteners maintain the vertical position of the load bearing portion whereas the tab/slot engagement maintains the installed position of the cover portion.

Additional features of the invention will become apparent and a fuller understanding will be obtained, in reading the following detailed description made in connection with the accompanying drawings.

BEST MODE FOR CARRYING OUT THE INVENTION

Figure 1:
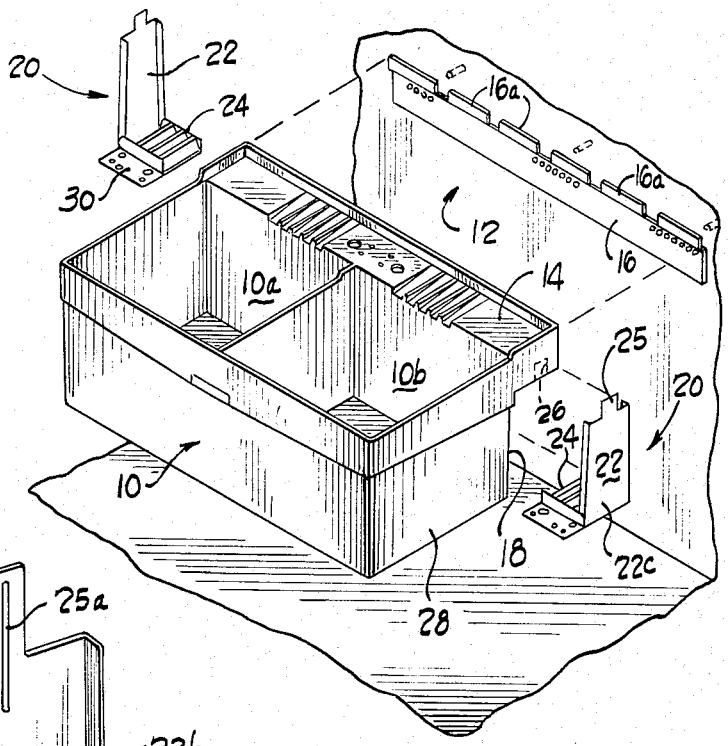
FIG. 1 is an exploded view of a wall hung laundry tub and an apparatus for mounting the tub to a vertical support surface, constructed in accordance with the preferred embodiment of the invention.

FIG. 1 illustrates a wall hung laundry tub 10 and mounting apparatus constructed in accordance with the preferred embodiment of the invention for securing the tub 10 to a tub mounting surface such as a vertical wall 12. The laundry tub 10 is substantially conventional in construction and includes two compartments 10*a*, 10*b* and an upper ledge 14 that includes soap shelves and apertures for plumbing connections.

The hardware for attaching the laundry tub 10 to the wall 12 includes a conventional wall plate 16 that is suitably attached to the wall by conventional fasteners. The wall plate 16 includes a series of outwardly bent flanges 16*a*. Alternately, the mounting plate 16 can be formed with a continuous flange across the top. The flanges 16*a* engage the underside of the ledge 14 of the laundry tub 10 in a conventional manner and thus mount and secure the upper portion of the tub to the wall 12.

As should be apparent in FIG. 1, once the tub 10 is hung on the wall plate 16, an access space is defined below the ledge 14, between the wall 12 and a rear side 18 of the tub 10. This opening or space provides clearance for plumbing connections.

Figure 2:
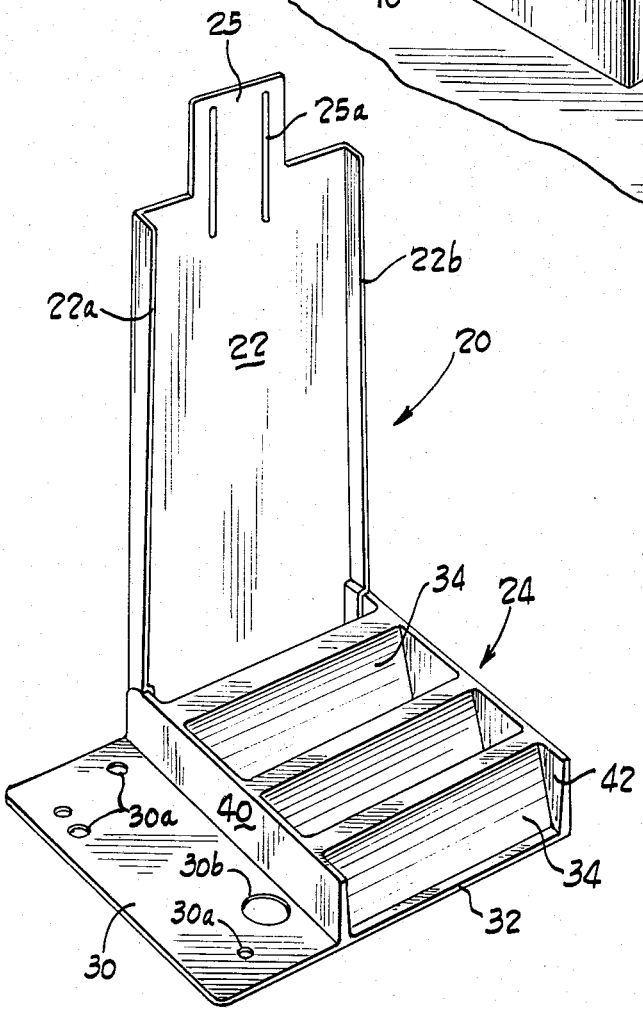
FIG. 2 is a perspective view of a side filler forming part of the laundry tub mounting apparatus.

In accordance with the present invention, a new and improved sideplate or "side filler" 20 is used to cover the access space once the plumbing has been connected and to provide support at the bottom of the tub 10 to prevent the tub from rocking about the wall plate 16. Referring also to FIG. 2, the side filler 20 includes a cover portion 22 and a load bearing portion 24. In the installed position, the planes of the cover and load bearing sections 22, 24 define an angle of substantially 90°.

The cover portion 22 is of substantially planar construction except for relatively narrow, integrally formed flanges 22*a*, 22*b* that extend along opposite vertical edges. A tab 25 extends vertically from the top edge and is engageable with a complementary shaped slot 26 formed in the side of the laundry tub ledge 14 (shown in FIG. 1). Reinforcing ribs 25*a* are preferably formed on the tab 25 to provide added rigidity. When the side filler 20 is installed, the integrally formed flanges 22*a*, 22*b* abut the rear side 18 of the tub and the wall 12, respectively and the outer side surface 22*c* (shown in FIG. 1) is substantially flush with sides 28 of the tub 10.

Although the tab-slot engagement illustrated is preferred, it should be recognized that the engagement between the top of the side filler 20 and laundry tub ledge 14 can also be effected by a suitable fastener.

The load bearing portion 24 of the side filler 20 extends between the rear bottom edge of the laundry tub and the wall 12 and prevents the bottom of the tub from rocking towards and away from the wall 12 during use. This portion of the side filler includes a tub engaging plate-like extension 30 and a reinforced supporting section 32. The extension plate 30 extends transversely from the load supporting section and preferably includes a plurality of small apertures 30*a* and at least one larger aperture 30*b*. In the preferred construction, the tub 10 includes a downwardly depending pin or boss (not shown) located and sized to extend through the larger aperture 30*b* when the side filler 20 is installed. In positioning the side filler 20, the vertical tab 25 is inserted into the slot 26 formed in the tub ledge 14 while the boss is concurrently engaged in the aperture 30*b*. Once the side filler is installed, its position is maintained by threading one or more fasteners into the bottom of the tub through the small apertures 30*a*.

The support section 32 includes a plurality of parallel reinforcing ribs 34, preferably triangular in cross section that extend between upwardly directed, parallel abutment walls 40, 42. When the side filler 20 is installed, the outside faces of the abutment walls 40, 42 abut the rear of the tub and the wall 12, respectively.

The ribs 34 and abutment walls 40, 42 together provide a relatively rigid structure for maintaining the spatial distance between the bottom rear edge of the tub and the tub mounting wall 12. As seen in FIGS. 1 and 2, the walls 40, 42 parallel the tub mounting wall so that the ribs 34 are substantially othogonal to the plane of the wall 12. With this orientation, loading forces exerted by the tub are directed along the longitudinal axes of the ribs 34 which preferably intersect the plane of the tub mounting wall at substantially 90°. In this loading direction, the ribs are able to resist and support substantial forces.

Figure 3:
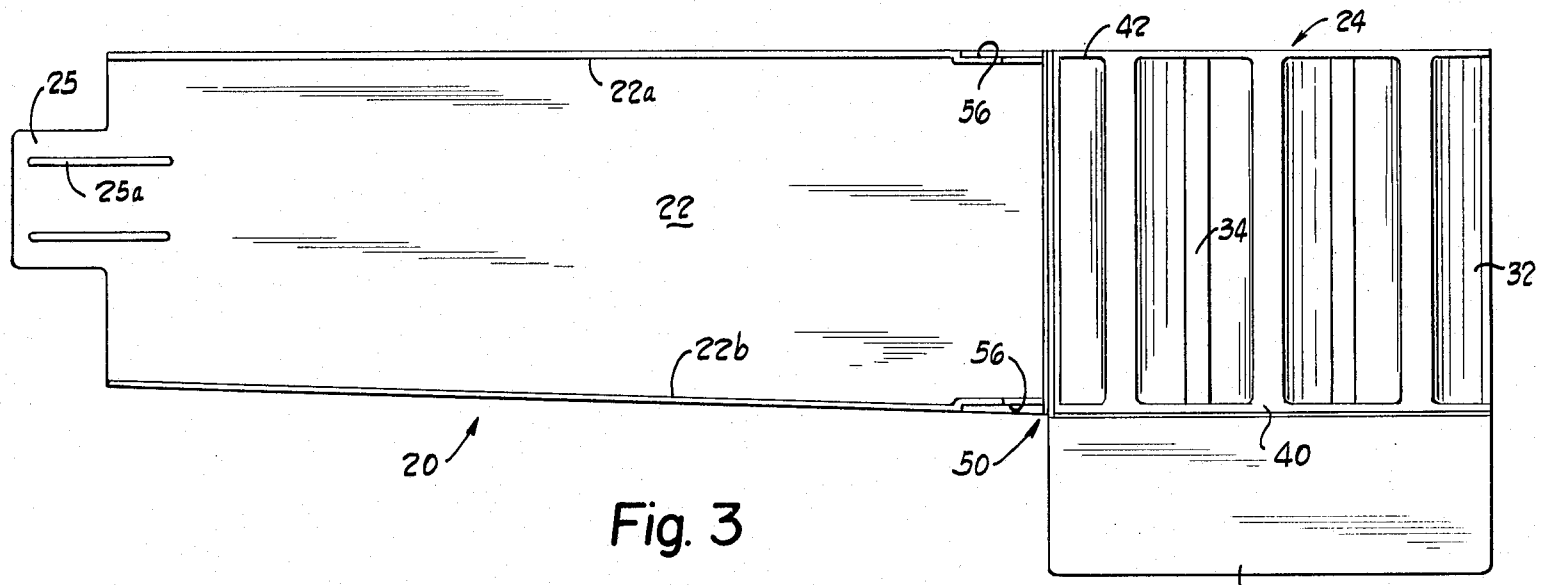
FIG. 3 is a plan view of the side filler, in a flat configuration, as it appears after manufacture.
Figure 4:
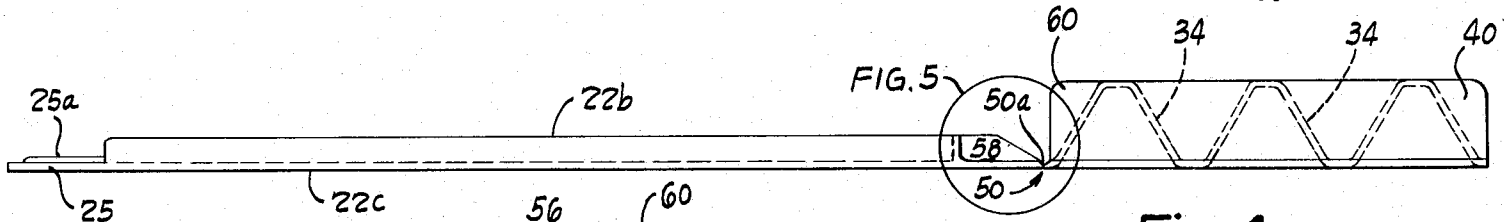
FIG. 4 is a side, elevational view of the side filler shown in FIG. 3.
Figure 5:
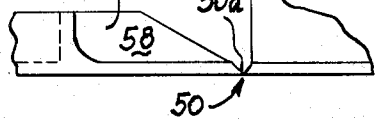
FIG. 5 is a fragmentary view of a portion of the side filler as indicated by the circle designated in FIG. 4.

In the preferred embodiment, the side filler 20 is molded as one piece from a plastic material such as polypropylene. Referring to FIGS. 3–5, the filler is preferably molded in a flat configuration and is bent into its installed shape, prior to installation. In accordance with this embodiment, the cover and load bearing portions 22, 24 are connected along a fold line indicated by the reference character 50 in FIGS. 3–5. The fold line is preferably formed parallel to the longitudinal axes of the ribs and is defined by a line of weakness. When the side filler is constructed from polypropylene, the fold line 50 preferably defines a living hinge so that the filler can be folded into its installed, L-shaped configuration without fracture or damage to the connection between the two portions. The living hinge is formed by reducing the cross-sectional area of the material at the fold line so that only a relatively thin bridging section 50*a* connects the two portions. By properly sizing the bridging section 50*a*, some deformation in the material will occur when the side filler is folded but it will remain intact and not separate or fracture.

According to a feature of the invention, the side filler 20 includes a structure which cooperates to further rigidize the side filler by inhibiting relative twisting between the portions 22, 24. As seen best in FIGS. 3 and 5, the flanges 22*a*, 22*b* of the cover portion 22 jog inwardly, slightly, near the fold line 50, to define relief areas or recesses 56. When the side filler is folded into its operative position, the relief areas 56 receive the corners 60 of respective abutment walls 40, 42. The inside surfaces of the corners 60 and relief side surfaces 58 abut each other in a juxtaposed arrangement, thus laterally interlocking the cover portion 22 and load bearing portion 24 at the junction between these two portions. This interfitting engagement reinforces the overall side filler when it is installed.

Although the illustrated ribs 34 are configured with a triangular cross-section, those in the art will recognize that ribs having somewhat different configurations would also be effective and are therefore contemplated by the present invention.

Although the invention has been described with a certain degree of particularity, it should be apparent that one having skill in the art can make various changes to it without departing from the spirit or scope of the invention as hereinafter claimed.

I claim:

1. A one-piece plastic side filler for a laundry tub, comprising:

(a) structure defining a cover portion and a load bearing portion interconnected by a line of weakness along which said filler is bent to position said cover and load bearing portions in an installed orientation;

(b) said cover portion defined by a substantially planar member that is sized to extend between a rear of the tub and a tub mounting surface;

(c) said cover portion including structure engageable with said tub to maintain said cover portion in its operative position;

(d) said load bearing portion including a plurality of reinforcing ribs extending between a lower portion of said tub and the tub mounting surface and operative to maintain a spatial relationship between said lower portion and said support surface;

(e) said cover portion including rigidizing structure for receiving and coacting with cooperating structure on said load bearing portion, said rigidizing structure receiving said cooperating structure when said cover and load bearing portions are bent into said installed orientation;

(f) said rigidizing structure comprising spaced recesses located near said line of weakness and said cooperating structure comprising corners of spaced abutment walls which enter said recesses when said side filler is bent.

2. Apparatus for mounting a laundry tub to a substantially vertical tub mounting surface, comprising:

(a) a mounting plate attachable to said mounting surface and engageable with an upper part of said tub;

(b) a one-piece plastic side filler extending between a rear part of said tub and said mounting surface, said side filler comprising:

(i) a cover portion including structure engageable with said upper part of said tub for maintaining said cover portion in a predetermined position with respect to said tub;

(ii) a load bearing portion coactable with a lower part of said tub and said mounting surface whereby said lower part of said tub is maintained a predetermined distance from said mounting surface, said load bearing portion of said side filler including spaced abutments for abuttably engaging said rear part of said tub and said mounting surface and a plurality of reinforcing ribs extending between said abutments, said load bearing portion further including tub engagement means engageable with structure located on a bottom part of said tub; and, (iii) a living hinge joining said cover portion to said load bearing portion, enabling said portions to be positioned in one position in which said portions are in a substantially common plane for shipping purposes and another position in which said portions are in substantially orthogonal planes.

3. The apparatus of claim 2 wherein said apparatus includes two side fillers.

4. The apparatus of claim 2 wherein the cover portion and the load bearing portion of said side filler means includes a cooperating structure that coacts when said portions are placed in their operative positions whereby twisting movement between said portions is inhibited.

5. The apparatus of claim 2 wherein each rib is triangular in cross-section having longitudinal axis substantially orthogonal to said tub mounting surface.

6. Apparatus for mounting a laundry tub to a substantially vertical tub wall, comprising:

(a) a mounting plate secured to the wall including outwardly projecting flange means engageable with a ledge forming part of said tub;

(b) one-piece plastic side fillers associated with the sides of said tub, located below said ledge and extending between the rear of said tub and said wall, each side filler comprising:

(i) a cover portion including structure engageable with the ledge of said tub for maintaining said cover portion in its operative position in which an outside planar surface of said cover portion is substantially flush with the side of said tub, said cover portion including front and rear flanges which abut the rear of the tub and the tub mounting wall, respectively, when the side filler is installed;

(ii) a load bearing portion extending between a lower part of said tub and said wall for maintaining a predetermined spatial distance between said tub and said wall, said load bearing portion comprising a transversely extending plate member engageable with said tub and a load supporting section including a plurality of ribs extending between upwardly projecting fore and aft abutment walls that confrontingly engage the rear of said tub and said wall, respectively;

(iii) means interconnecting said cover and load bearing portions and defining a fold line about which said cover and load bearing portions are bent to position said portions in their installed positions, said interconnecting means comprising a living hinge;

(iv) cooperating structure located near said interconnecting means which coacts when said side filler is bent into its installed configuration to inhibit relative twisting between said positions, said cooperating structure comprising recesses formed in said front and rear flanges of the cover portion adapted to receive corners of said fore and aft abutment walls when said portions are in their installed positions.

7. The apparatus of claim 6 wherein said ribs are triangular in cross-section and each rib defines a longitudinal axis that intersects said tub mounting wall at an angle of substantially 90°.

8. The apparatus of claim 6 wherein said structure for maintaining the installed position of said cover portion comprises a vertical tab extending vertically from said cover portion which is engageable with a mating slot formed in the ledge of said tub.

9. The apparatus of claim 6 wherein the engagement between said tub and said extension plate forming part of said load bearing portion is achieved by a pin/aperture arrangement.

10. The apparatus of claim 9 wherein said pin is defined by said tub and depends downwardly from a bottom surface of said tub and said aperture is defined by said extension plate.

11. The apparatus of claim 10 wherein said extension plate is secured to the bottom of said tub by at least one threaded fastener.

12. A one-piece plastic side filler member for a wall hung laundry tub comprising:

(a) a planar cover portion having side edge flanges;

(b) a load bearing portion at one end of said cover portion and connected thereto by a living hinge, whereby said filler member can be shipped flat and bent for installation into an L-shaped configuration with the plane of said load bearing portion perpendicular to said cover portion;

(c) said load bearing portion having parallel abutment walls which are spaced apart the width of said cover portion and project transversely thereof when said side filler member is bent into said L-shaped configuration, and load bearing ribs extending between said walls; and, (d) a plate-like extension projecting away from one of said walls, said extension having tub-locating portions.

13. A side filler as claimed in claim 12 wherein end portions of said walls are in locking engagement with said flanges when said filler member is in said L-shaped configuration.

* * * * *